US007431187B2

(12) United States Patent
Tachihara et al.

(10) Patent No.: US 7,431,187 B2
(45) Date of Patent: Oct. 7, 2008

(54) NAILER

(75) Inventors: Sueji Tachihara, Ibaraki (JP); Masao Hamada, Ibaraki (JP); Akira Oono, Ibaraki (JP)

(73) Assignee: Hitachi Koki, Co., Ltd., Tokyo (JP)

( * ) Notice: Subject to any disclaimer, the term of this patent is extended or adjusted under 35 U.S.C. 154(b) by 0 days.

(21) Appl. No.: 10/849,440

(22) Filed: May 20, 2004

(65) Prior Publication Data

US 2004/0238593 A1 Dec. 2, 2004

(30) Foreign Application Priority Data

May 26, 2003 (JP) ..... P.2003-148443

(51) Int. Cl.
*B25C 7/00* (2006.01)

(52) U.S. Cl. ..... 227/142; 227/108; 227/140

(58) Field of Classification Search ..... 227/142, 227/120, 149, 8; 173/115
See application file for complete search history.

(56) References Cited

U.S. PATENT DOCUMENTS 4,821,937 A * 4/1989 Rafferty ..... 227/8
5,219,110 A * 6/1993 Mukoyama ..... 227/8
5,261,587 A * 11/1993 Robinson ..... 227/8
5,385,286 A * 1/1995 Johnson, Jr. ..... 227/8
5,472,131 A * 12/1995 Kubota ..... 227/67
5,564,614 A * 10/1996 Yang ..... 227/142
5,579,977 A * 12/1996 Yang ..... 227/142
5,582,615 A * 12/1996 Foshee et al. ..... 606/139
5,667,127 A * 9/1997 Ichikawa et al. ..... 227/142
5,685,473 A * 11/1997 Shkolnikov et al. ..... 227/8
5,785,227 A * 7/1998 Akiba ..... 227/8
6,024,267 A * 2/2000 Chen ..... 227/8
6,170,729 B1 * 1/2001 Lin ..... 227/8
6,176,412 B1 * 1/2001 Weinger et al. ..... 227/142
6,557,745 B2 * 5/2003 Wang ..... 227/142
6,578,750 B2 * 6/2003 Kubo et al. ..... 227/142
6,581,815 B1 * 6/2003 Ho et al. ..... 227/142
6,763,992 B2 * 7/2004 Hirai ..... 227/142
6,857,547 B1 * 2/2005 Lee ..... 227/8

FOREIGN PATENT DOCUMENTS

JP 60-117072 8/1985
JP 10-286784 10/1998
JP 2000-174520 6/2000
JP 2003-136429 5/2003

OTHER PUBLICATIONS

Japanese Office Action dated Jan. 18, 2008, with English language translation.

* cited by examiner

*Primary Examiner*—Brian D. Nash
(74) *Attorney, Agent, or Firm*—McGinn IP Law Group, PLLC

(57) ABSTRACT

A wrenching portion provided in an adjuster and employed for assembling is formed at a gripping portion for rotation. The gripping portion is formed in a polygonal shape. In this configuration, the adjuster is decreased in size and weight and its operability of adjusting a driving depth is improved. An undercut portion is removed in a vertical direction and a non-slip rugged portion is provided in only a longitudinal direction so that it can be manufactured in a simple tow-part mold, thereby reducing the production cost.

11 Claims, 6 Drawing Sheets

NAILER

BACKGROUND OF THE INVENTION

1. Field of the Invention

The present invention relates to a nailer having a device for adjusting the driving depth of a nail.

2. Description of the Related Art

A previously known method for adjusting the level difference between the head of a nail drived by a nailer and the surface of a member-to-be-drived, i.e. driving depth is proposed in JP-A-10-286784. In this known method, the distance between the tip of a push lever in contact with the member-to-be-drived and the tip of the driver blade at a lower dead point, i.e. the projecting quantity S of the driver blade can be made adjustable.

FIG. 7 shows the state where a push lever 15 has been pressed to an member-to-be-drived 12 in order to make a driving operation in a drived status of a nailer having a conventional driving depth adjusting device. The push lever 15, an adjuster 6 and a push lever 16 (hereinafter, these three components are correctively referred to as "a push lever 5") is raised against the load of a spring 17 which is always urged toward the member-to-be-drived 12, and is further raised in engagement with a switch arm 18. When the touching surface 19 of the push lever 16 is touched to the touching surface 31 of a push lever guide, the push lever 5 stops to ascend. When a switch 3 is pulled, the driver blade 1 is dropped to drive a nail 2, thereby determining the driving depth by a projecting quantity S from the tip 13 of the push lever 15 to the tip 11 of the driver blade 1. Since the push lever 16 is screw-engaged with the adjuster 6, the adjuster 6 is rotated beforehand to expand/contract the push lever 5. In this way, the driver blade projecting quantity S in nail driving is determined, thereby adjusting the driving depth. The adjuster 6, as shown in FIG. 8, includes a wrenching portion 7 employed in assembling and a gripping portion 28 for rotation of the adjuster (hereinafter referred to simply "gripping portion") employed in adjusting the driving depth. The adjuster 6 is generally manufactured by machining or resin molding.

SUMMARY OF THE INVENTION

In a nailer having a conventional driving depth adjusting device, the wrenching portion 7 and gripping portion 28 are separately formed in the adjuster 6. Therefore, the adjuster 6 must have a certain length. In the case where the adjuster 6 is manufactured by machining, it cannot be manufactured only by lathing because the wrenching portion 7 must be machined. This leads to the problem of an increase in the production cost. Further, if the diameter of the gripping portion 28 is decreased in order to reduce the size and weight of the adjuster 6, the rugged portion 8 formed on the rotation gripping portion is slippery, thereby making it difficult to rotate the gripping portion 28. On the other hand, in the case where the adjuster 6 is manufactured by resin molding, if the shape of the rugged portion 8 for preventing slippage (hereinafter referred to as a non-slip rugged portion), an undercut portion 9 for reducing the weight located at a central position in the longitudinal direction and a spring housing hole 30 for a steel ball for preventing advertent rotation of the adjuster 6, etc. are taken into consideration, the adjuster cannot be manufactured through simple two-part mold, but must be manufactured through multiple-part mold. This leads to the problem of an increase in the production cost.

An object of this invention is to provide a nailer having a driving depth adjusting device which is compact and lightweight and is easy to operate.

The above object can be attained by the shape of the adjuster in which a wrenching portion is formed at a gripping portion to shorten the entire length of the adjuster; the gripping portion is formed in a polygonal shape to facilitate the rotation with a rugged portion; and no undercut is provided in a longitudinal direction and the rugged portion is provided in only the longitudinal direction so that it can be manufactured in a simple tow-part mold.

DETAILED DESCRIPTION OF THE PREFERRED EMBODIMENTS

Figure 4:
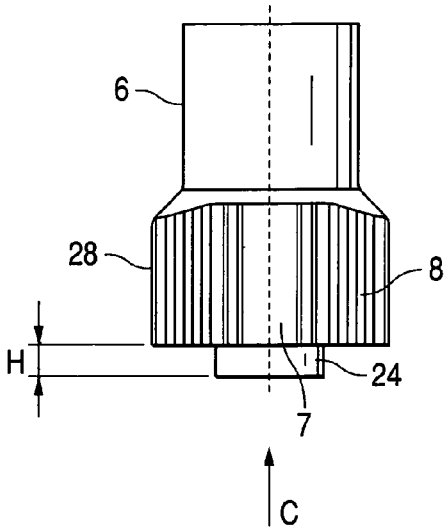
FIG. 4 is a side view of an adjuster according to this invention.
Figure 5:
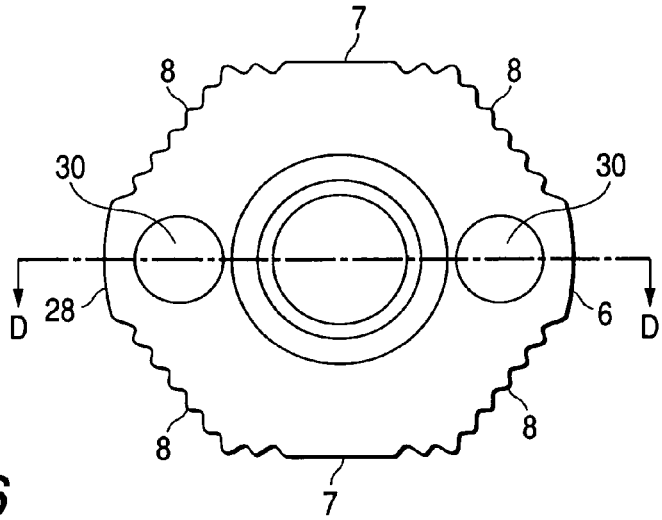
FIG. 5 is an expanded view of the adjuster shown in FIG. 4 when viewed from arrow C.
Figure 6:
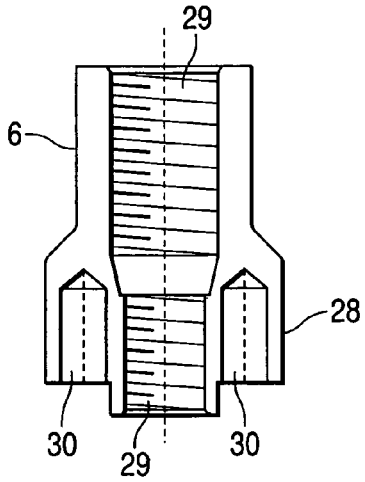
FIG. 6 is a sectional view of the adjuster taken in line D-D in FIG. 5.
Figure 7:
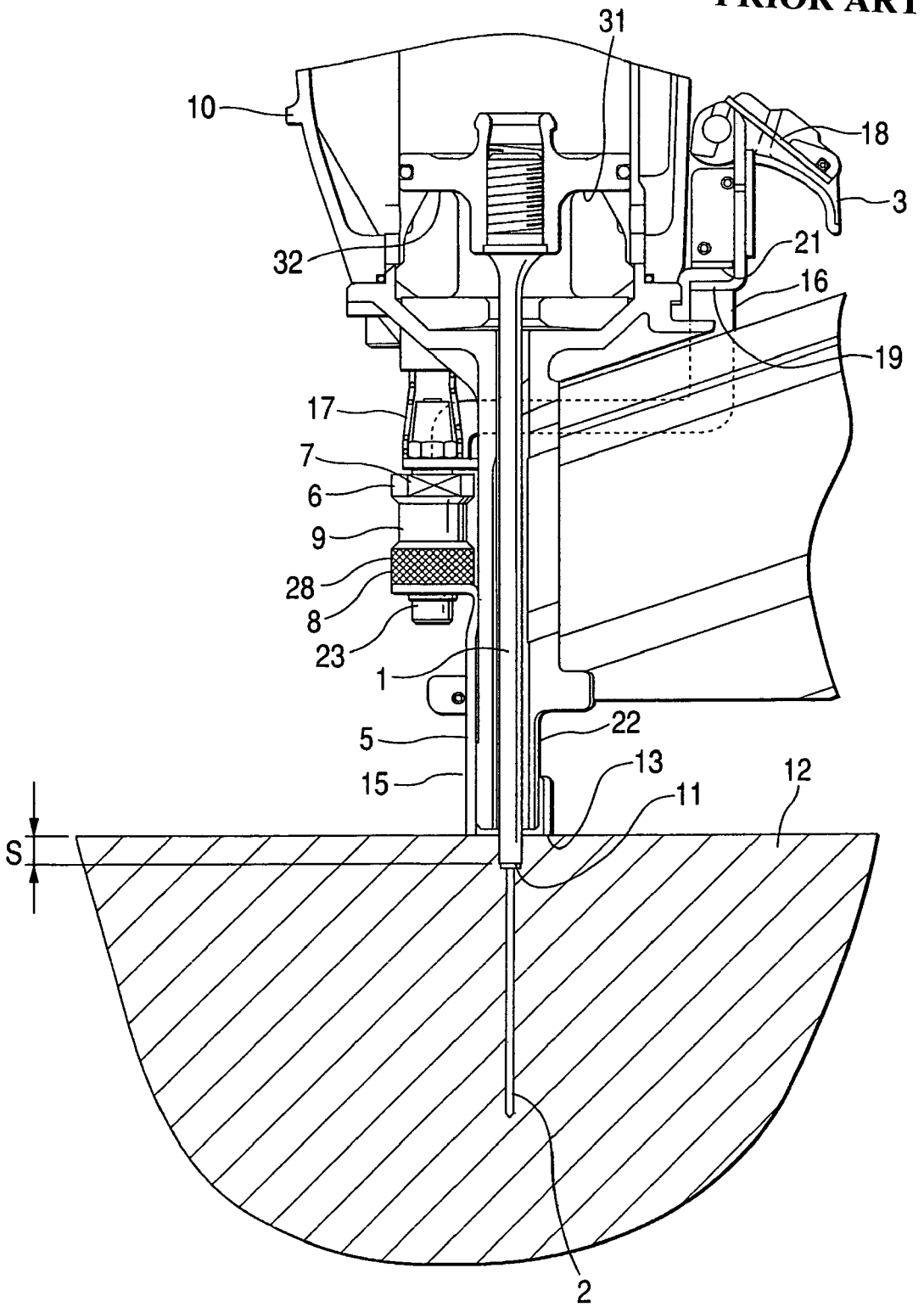
FIG. 7 PRIOR ART
FIG. 7 is a partial sectional view showing a conventional nailer adjusting device during a driving operation.
Figure 8:
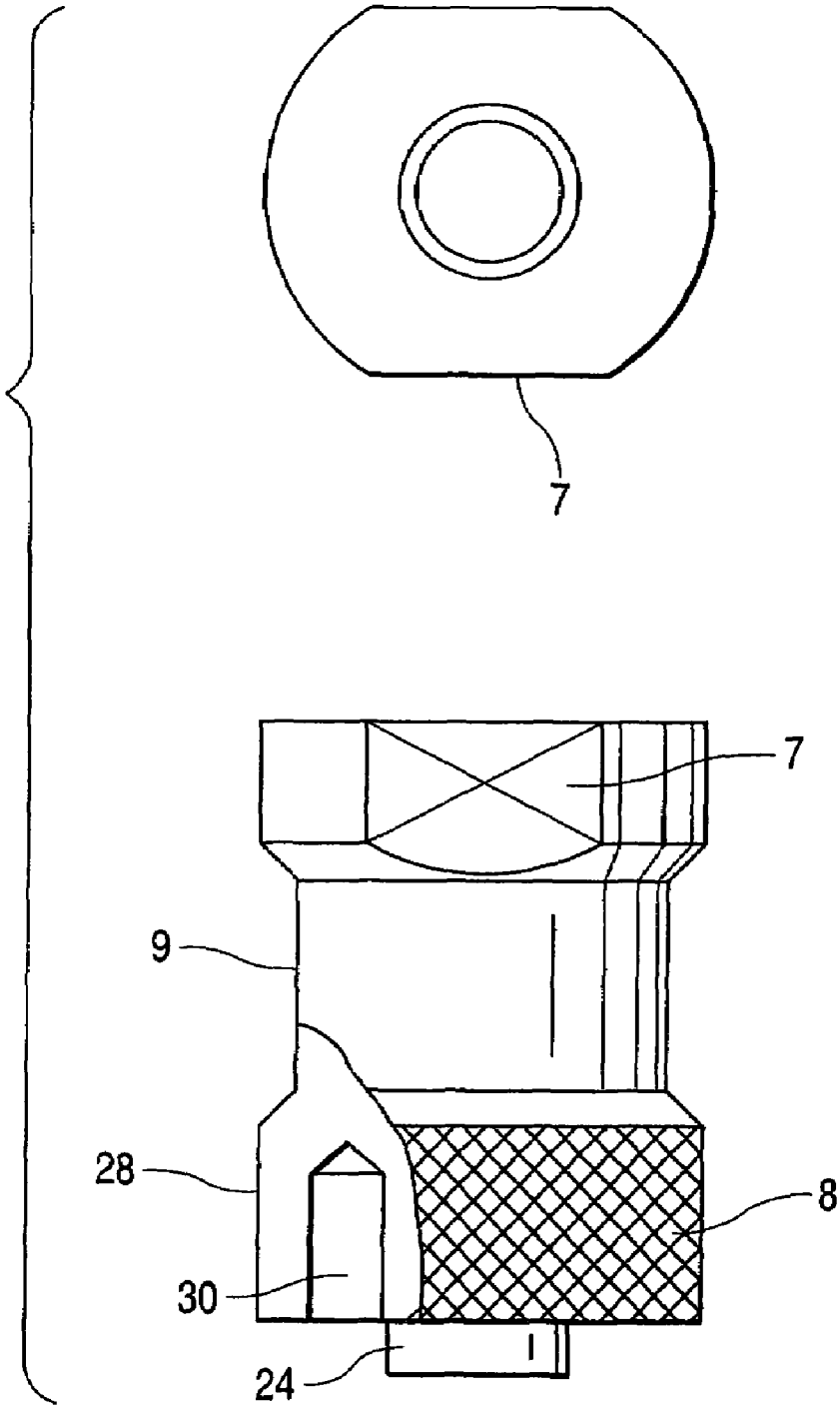
FIG. 8 PRIOR ART
FIG. 8 is a plan view of the adjuster shown in FIG. 7 and a partial sectional view thereof.

FIGS. 1 to 6 show an embodiment of a nailer 10 of this invention. In these figures, a push lever 15 is slidably arranged on a nose 22 and attached at its upper end to an adjuster 6 by a bolt 23. A projection 24 of the adjuster 6 shown in FIG. 4 is bolted into a hole 35 (FIG. 3) of the push lever 15 by a bolt 23. In this case, since the height H of the projection 24 is slightly larger than the thickness of the push lever 15, the push lever 15 is not tightened and so the adjuster 6 is rotatable. In order to prevent the adjuster 6 from being rotated owing to the shock in nailer driving, a steel ball 26 and a spring 27 are arranged in two grooves 30 which are provided by 180° apart from each other on the one end of the adjuster 6, respectively. The steel ball 26 is always urged toward the push lever 15 by the spring 27 so that it has sunk by about ⅓ in a groove 26 of the push lever 15 in a relationship between the diameter of the steel ball 26 and the radius of the groove of the push lever 15. In order to rotate the adjuster 6 from this state, a running torque must be given to the adjuster 6 against the above load so that the steel balls 26 sunk in the grooves 25 of the push lever 15 float onto the upper surface 33 of the push lever 15. Therefore, the adjuster 6 must be rotated with the rotation gripping portion 28 being firmly gripped by fingers. Since the upper portion of the adjuster 6 is screw-engaged with the push lever 16, when the adjuster 6 is rotated, the gap D between the adjuster 6 and push lever 16 is increased or decreased. Namely, the entire push lever 5 is expanded or contracted. The push lever 5 is always urged by the spring 17 toward the member to-be-drived. As shown in FIGS. 4 to 6, the wrenching portion 7 of the adjuster 6 must have a certain width which permits the torque for tightening the bolt 23 to be received from a wrench. In accordance with this invention, as shown in FIG. 5, the wrenching portion 7 is formed at the rotation gripping portion 28. This makes it unnecessary to provide a large diameter portion separately. Thus, the adjuster 6 itself can be shortened and so the nailer can be downsized. The rotation gripping portion 28, as shown in FIG. 5, is provided with non-slip rugged portions at four positions and formed in a polygonal shape. Therefore, the rotation gripping portion has an outer periphery which is short and effective to rotate the adjuster 6. Further, since the entire length of the adjuster 6 is short, unlike the conventional adjuster, an undercut portion 9 is not required on the way between the rotation gripping portion 28 and the wrenching portion 7. In the case where the adjuster 6 is manufactured by resin molding, since there are a screw-hole 29 for engagement between the push levers 15 and 16 at the central portion and grooves 30 each receiving the spring 27 as shown in FIG. 6, a molding die must be divided in a longitudinal direction. As described above, since the wrenching portion 7 is formed at the rotation gripping portion 28, no undercut is provided at the central portion. Therefore, the molding die can be divided in the longitudinal direction. Further, since the non-slip rugged portions are rugged in only the longitudinal direction, the molding die can be divided in the longitudinal direction.

Figure 1:
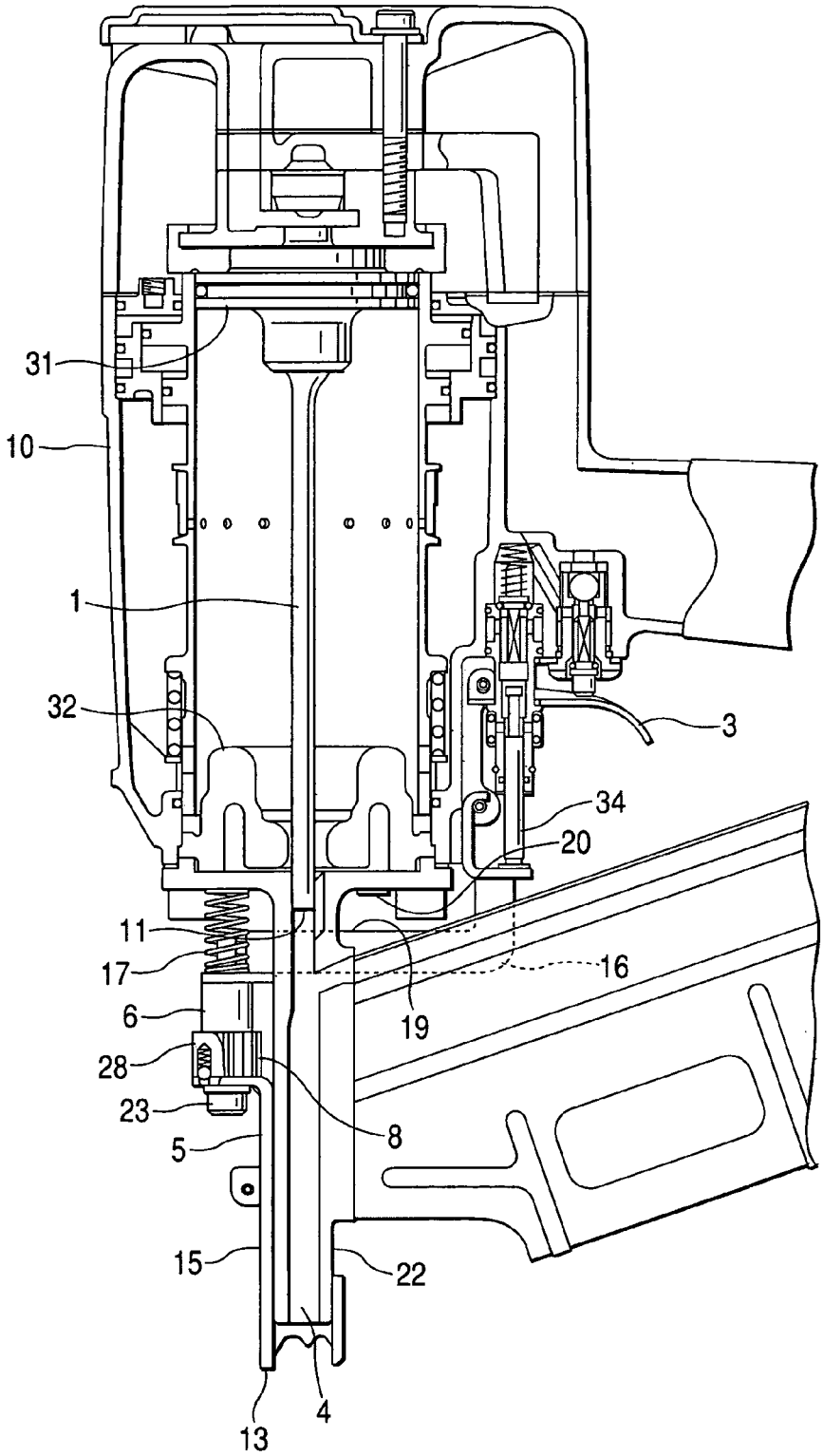
FIG. 1 is a partial sectional view showing an embodiment of a nailer according to the present invention.
Figure 2:
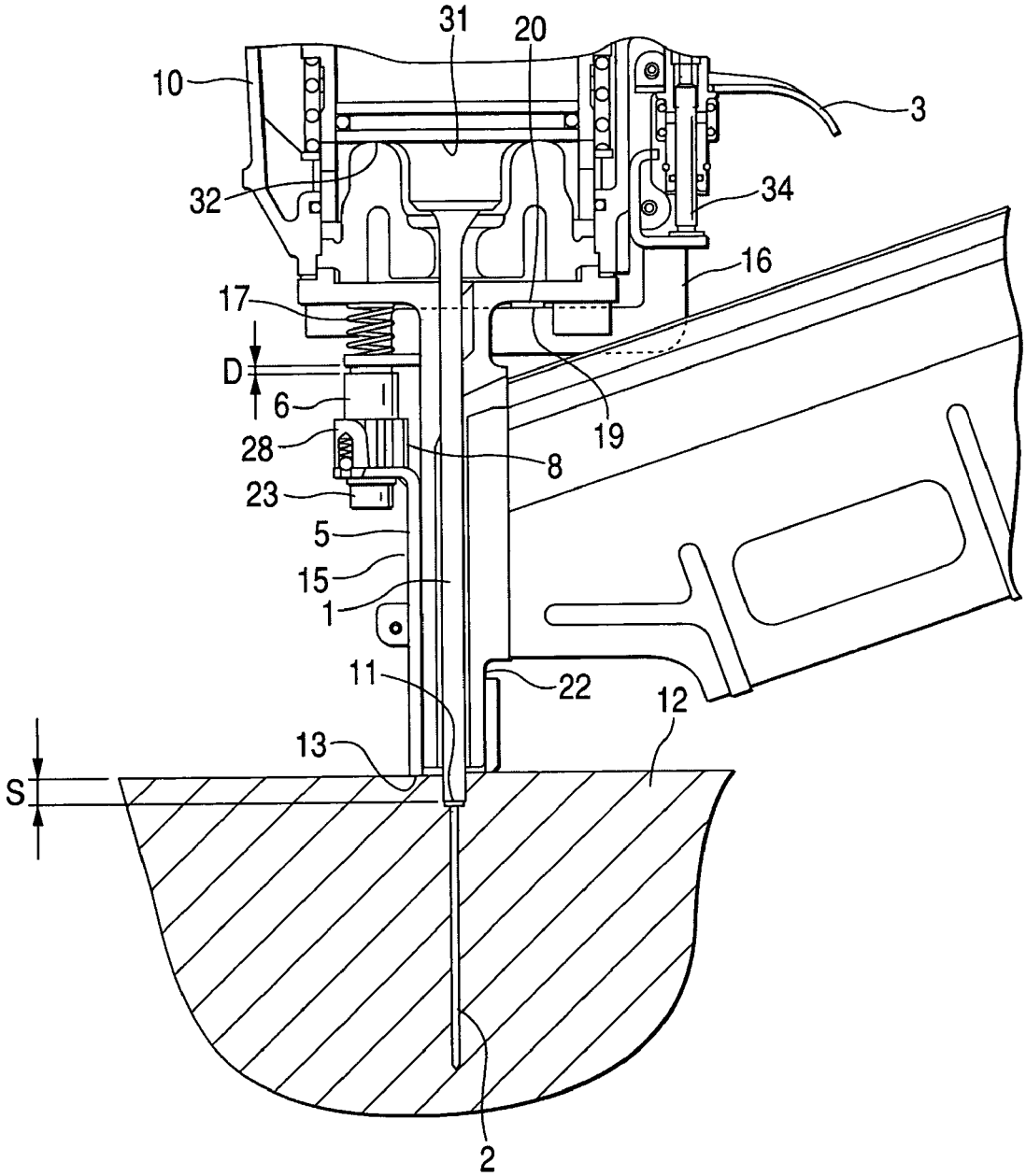
FIG. 2 is a partial sectional view for explaining the driving operation in FIG. 1.
Figure 3:
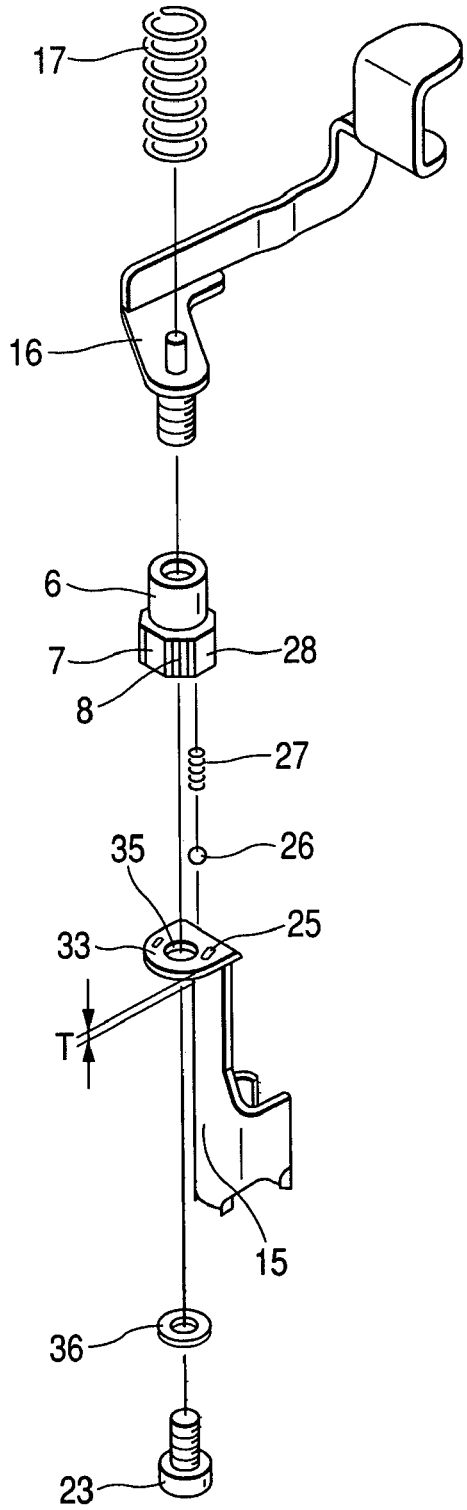
FIG. 3 is a component-exploded view of a nailer adjusting device in FIG. 1.

With the configuration described above, nail driving is carried out as follows. In the case where the push lever 5 is raised against the spring 17, which always presses the tip of the push lever 15 onto the member-to-be-drived 12 and hence always urges the push lever 5 toward the member-to-be-drived 12, as shown in FIG. 2, when the touching surface 19 of the push lever 16 is touched to the touching surface 20 of the nose 22, the push lever 5 stops to ascend. Specifically, the upper dead point of the push lever 16 is predetermined. Therefore, the expansion/contraction of the push lever 5 based on the rotating operation of the adjuster 6 adjusts the position of the tip of the push lever 15 vertically. Near the upper dead point, the upper end of the push lever 16 engages with a plunger 34 and pushes up it. In this state, when the switch 3 is pulled, the driver blade 1 drops abruptly. When the touching surface 31 of the piston is touched to the upper surface 32 of a piston bumper, the driver blade 1 stops to drop, thereby driving a nail 2 from an ejection opening 4. The driving depth of the nail 2 is determined by the distance from the tip 11 of the driver blade 1 to the tip 13 of the push lever 15, i.e. the projecting quantity S of the driver blade 1. In the case where the driving depth is made shallow, if the adjuster 6 is rotated to extend the push lever 5 so that the distance D between the push lever 16 and the adjuster 6 is increased, the adjuster 6 and push lever 15 descend so that the projecting quantity S of the tip 14 of the driver blade 1 decreases. Thus, the driving depth decreases.

In accordance with this invention, a wrenching portion is formed at a gripping portion of an adjuster, and the adjuster is formed in a polygonal shape and provided with non-slip rugged portions at several points. The adjuster is also formed in a shape which permits a simple two-part resin molding in a vertical direction. Thus, a driving depth adjusting device can be provided which is compact and lightweight and is easy to operate.

What is claimed is:

1. A nailer comprising:

a nailer body;

a drive blade incorporated in the nailer body;

a switch portion for controlling operation of the drive blade;

a push lever comprising one end connected to the switch portion and comprising a first push lever component and a second push lever component; and an adjuster connecting said first push lever component to said second push lever component, said adjuster comprising:

a gripping portion having a shape of a polygonal column that includes a top surface, a bottom surface and a plurality of side surfaces on an exterior periphery of said gripping portion;

a first member that extends from the top surface of the gripping portion and is screw-engaged with the first push lever component so that an entire length of the push lever is changed when the gripping portion is rotated;

a second member that extends from the bottom surface opposite to the top surface of the gripping portion and projects through a hole of the second push lever component; and a bolt member that connects the second member of the adjuster to the second push lever component, wherein at least one of said plurality of side surfaces of the gripping portion is provided with a non-rugged wrenching portion for bolting and at least one of said plurality of side surfaces, other than the side surface on which said non-rugged wrenching portion is provided, of the gripping portion is provided with a rugged portion for rotation of the adjuster.

2. The nailer according to claim 1, wherein a height of the second member is slightly larger than a thickness of the second push lever component so that the adjuster is rotatable relative to the second push lever component.

3. The nailer according to claim 1, wherein the adjuster comprises a shape in which no undercut is provided in a longitudinal direction of the adjuster and the rugged portion comprises two molded parts.

4. The nailer according to claim 1, wherein said adjuster includes a plurality of holes formed 180° apart in the bottom surface of said adjuster, and wherein said nailer further comprises a ball and spring arranged in at least one of said plurality of holes, said ball being urged toward said second push lever component by said spring.

5. A nailer comprising:

a nailer body;

a drive blade incorporated in the nailer body;

a switch portion for controlling operation of the drive blade;

a push lever comprising one end connected to the switch portion and comprising a first push lever component and a second push lever component, a push lever groove being disposed in an end of one of said first push lever component and said second push lever component;

an adjuster comprising a gripping portion for rotation to increase and decrease an entire length of the push lever in an operating direction of the drive blade, said gripping portion having a shape of a polygonal column that includes a top surface, a bottom surface, and a plurality of side surfaces on an exterior periphery of said gripping portion, said adjuster connecting said first push lever component to said second push lever component, said adjuster comprising a plurality of holes formed 180° apart in an end of said adjuster; and a ball and spring arranged in at least one of said plurality of holes, said ball being urged toward one of said first push lever component and said second push lever component by said spring such that said ball is sunk into said push lever groove, wherein a non-rugged wrenching portion for bolting is formed on at least one of said plurality of side surfaces of at the gripping portion, and wherein a rugged portion is substantially formed on at least one of said plurality of side surfaces, other than the side surface on which said non-rugged wrenching portion is provided, of the gripping portion.

6. The nailer according to claim 5, wherein said rugged portion is formed in a longitudinal direction.

7. The nailer according to claim 5, wherein the gripping portion comprises an octagonal shape.

8. The nailer according to claim 5, wherein an upper portion of said adjuster is screw-engaged with said push lever.

9. The nailer according to claim 5, wherein the gripping portion comprises a polygonal shape.

10. An adjuster for a nailer comprising:

a rotatable gripping portion that selectively increases and decreases an entire operating length of a push lever in an operating direction of a drive blade of the nailer, said adjuster connecting a first push lever component to a second push lever component, said gripping portion having a shape of a polygonal column that includes a top surface, a bottom surface, and a plurality o side surfaces on an exterior periphery of said gripping portion;

a plurality of holes formed 1800 apart in an end of said adjuster; and a ball and spring arranged in at least one of said plurality of holes, said ball being urged toward one of the first push lever component and the second push lever component by said spring such that said ball is sunk into a push lever groove formed in an end of one of said first push lever component and said second push lever component, wherein a non-rugged wrenching portion for bolting is formed on at least one of said plurality of side surfaces of the gripping portion, and wherein a rugged portion is substantially formed on at least one of said plurality of side surfaces, other than the side surface on which said non-rugged wrenching portion is provided, of the gripping portion.

11. The adjuster according to claim 10, wherein the gripping portion comprises an octagonal shape.

* * * * *